US007958570B1

(12) United States Patent
Mooney

(10) Patent No.: US 7,958,570 B1
(45) Date of Patent: Jun. 14, 2011

(54) CAP SHAPE RETAINER INSERT

(76) Inventor: John Joseph Mooney, Canton, MA (US)

( * ) Notice: Subject to any disclaimer, the term of this patent is extended or adjusted under 35 U.S.C. 154(b) by 136 days.

(21) Appl. No.: 12/535,175

(22) Filed: Aug. 4, 2009

(51) Int. Cl.
*A42B 1/02* (2006.01)

(52) U.S. Cl. ..... 2/195.5

(58) Field of Classification Search ..... 2/195.5, 2/181.4, 181.6, 182.1, 182.2, 182.3, 182.8, 2/209.13; 223/24, 25, 84
See application file for complete search history.

(56) References Cited

U.S. PATENT DOCUMENTS

| | | | | | |
|---|---|---|---|---|---|
| 999,322 | A | | 8/1911 | Levin | |
| 1,275,023 | A | * | 8/1918 | Hausinger | 2/181.4 |
| 1,419,517 | A | * | 6/1922 | Powels | 2/181.4 |
| 1,422,366 | A | | 7/1922 | Leger | |
| 1,493,194 | A | * | 5/1924 | Ellis | 2/181.4 |
| 1,501,507 | A | | 7/1924 | Wetherbee | |
| 2,178,860 | A | * | 11/1939 | Knibloe | 2/181.4 |
| 2,505,403 | A | * | 4/1950 | Jacobi | 2/175.4 |
| 2,576,690 | A | * | 11/1951 | Maniglia | 2/175.4 |
| 2,651,045 | A | * | 9/1953 | Shenkman | 2/175.4 |
| 2,740,567 | A | * | 4/1956 | Kaufman | 223/84 |
| 3,133,289 | A | | 5/1964 | Lipschultz | |
| 4,637,077 | A | | 1/1987 | Henschel | |
| 4,790,034 | A | | 12/1988 | Pass | |
| 5,481,760 | A | | 1/1996 | Wood, Jr. | |
| 5,987,649 | A | * | 11/1999 | Robertson | 2/195.5 |

* cited by examiner

*Primary Examiner* — Danny Worrell
(74) *Attorney, Agent, or Firm* — Steven N. Fox, Esq.

(57) ABSTRACT

The present invention is an insert that may be placed within a cap such as base ball cap or a golf cap to maintain the original shape of the cap. In one embodiment, the insert comprises a one piece flexible sheet having a centrally located longitudinal axis dividing the sheet into left and right halves that are mirror images of each other. The sheets has square shaped holed spaced throughout the sheet to provide increased ventilation. The sheet has a non-continuous peripheral edge having catch portions to prevent the insert from slipping during use of the cap. The sheet further comprises a lower portion having a central edge portion substantially perpendicular to the longitudinal axis. The lower portion comprises left and right edge portion inclined to the longitudinal axis. The lower portion further comprises a v-shaped cut-out extending inward from the central edge. The v-shaped cut-out allows the left and right halves of the sheet to be bent so that the left and right edge portions be properly seated within the cap to provide a proper shape. The upper portion further comprises first, second, and third flexible support fingers and first and second valleys spacing the fingers. The first and second valleys are of sufficiently deep so as to allow the fingers to be highly flexible. When the insert is placed in the cap, the fingers promote a concave shape at the intersection of the front face and top portion of the cap.

12 Claims, 4 Drawing Sheets

CAP SHAPE RETAINER INSERT

BACKGROUND OF THE INVENTION

Billed caps of all types such as baseball caps, golf caps, and sun caps are widely used by children and adults. The vast majority of caps have a front portion or face that is slightly less than upright or perpendicular to the bill. As a result of extended use and construction materials, the front face of the cap loses its upright shape. Conventional inserts have been developed in an attempt to solve this problem. Such conventional inserts are not without their drawbacks. By way of example only, conventional inserts do not maintain the proper shape of the cap; tend to slip or move during use of the cap; and do not provide adequate ventilation.

SUMMARY OF THE INVENTION

One object of the present invention is to provide an insert that can be placed into a cap to prevent the cap front losing its original front shape.

The present invention is an insert that may be placed within a cap to maintain the desired shape of the cap. In one embodiment, the insert comprises a one piece flexible sheet having a centrally located longitudinal axis dividing the sheet into left and right halves that are mirror images of each other. The sheets has square shaped holed spaced throughout the sheet to provide increased ventilation. The sheet has a non-continuous peripheral edge having catch portions to prevent the insert from slipping during use of the cap. The sheet further comprises a lower portion having a central edge portion substantially perpendicular to the longitudinal axis. The lower portion comprises left and right edge portion inclined to the longitudinal axis. The lower portion further comprises a v-shaped cut-out extending inward from the central edge. The v-shaped cut-out allows the left and right halves of the sheet to be bent so that the left and right edge portions be properly seated within the cap to provide a proper shape. The upper portion further comprises first, second, and third flexible support fingers and first and second valleys spacing the fingers. The first and second valleys are of sufficiently deep so as to allow the fingers to be highly flexible. When the insert is placed in the cap, the fingers promote a concave shape at the intersection of the front face and top portion of the cap.

BRIEF DESCRIPTION OF THE DRAWINGS

The following description of the invention will be fully understood with reference to the accompanying drawings in which.

DETAILED DESCRIPTION OF THE INVENTION

Figure 1:
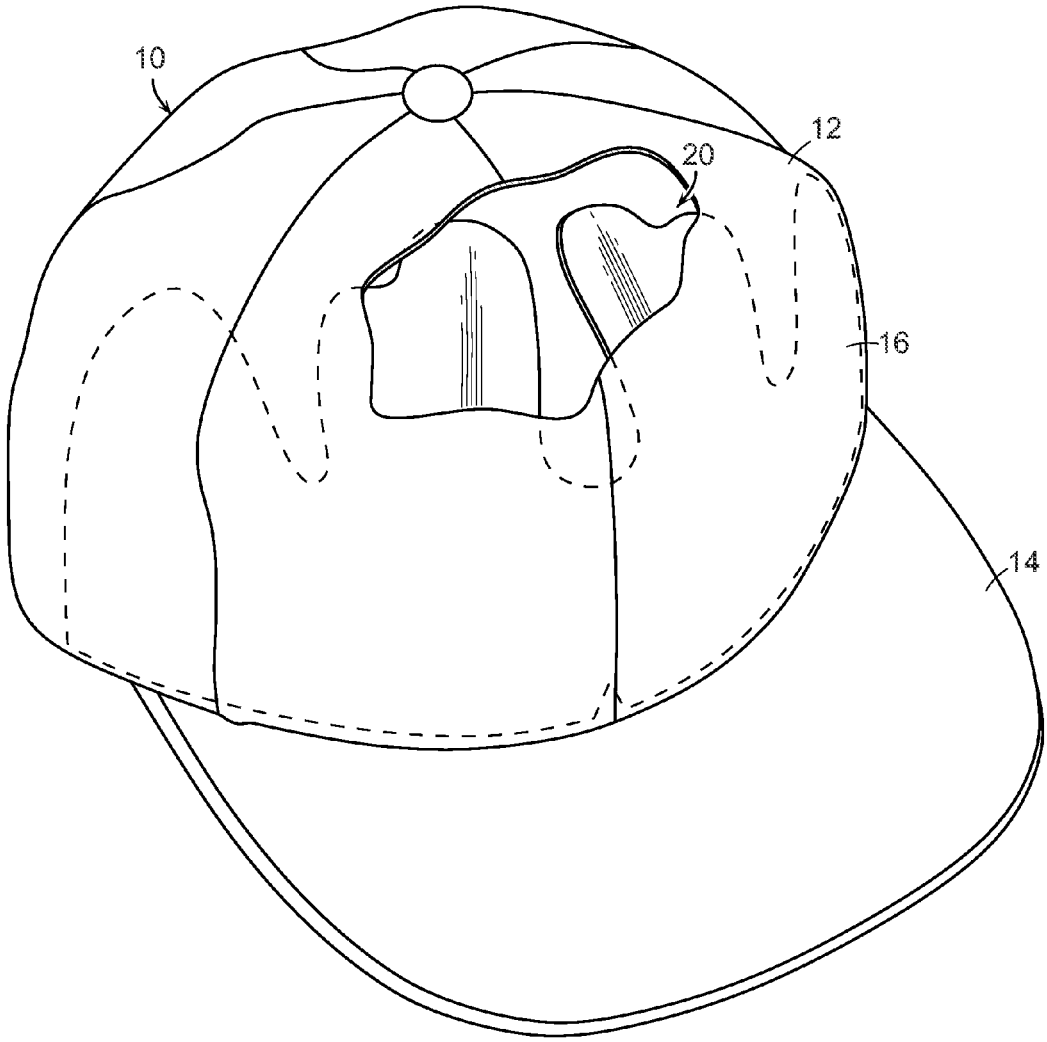
FIG. 1 is a top perspective view of an insert according to the present invention positioned within a conventional cap.

Referring to FIG. 1, the present invention is an insert 20 for use with a cap 10 having a top portion 12, a bill 14, and a front face 16 to maintain the original shape of the cap 10 over extended use and conditions. Cap 10 may be any type of cap such as baseball caps, golf caps, and sun caps which are widely used by children and adults.

Figure 6:
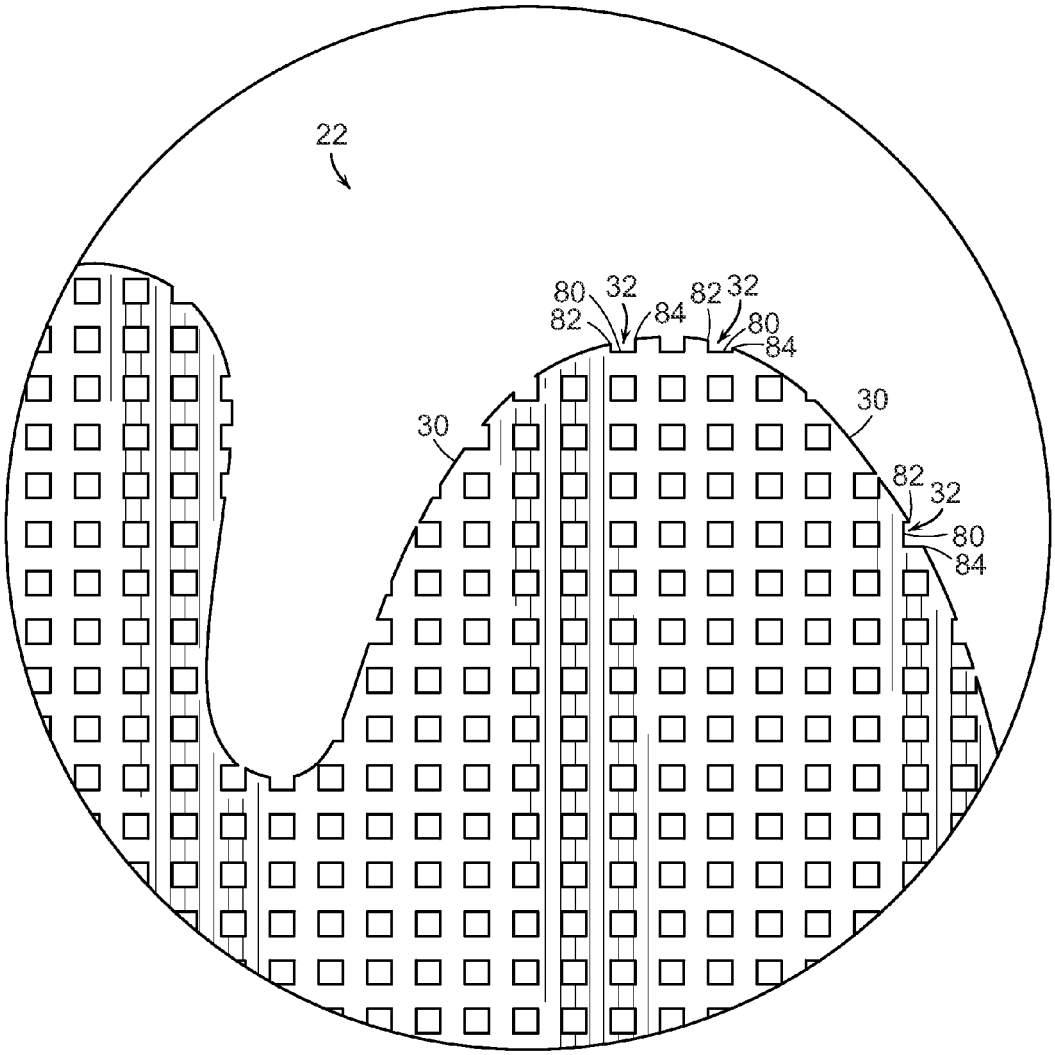
FIG. 6 is an exploded view of a portion of the third and fourth fingers showing the non-continuous catch portions and square shaped holes of the insert.

Referring to FIGS. 2-7, insert 20 comprises a one piece flexible sheet 22 made from a nonporous and flexible and semi-rigid material such as plastic. Sheet 22 has a thickness of about 1/16th inches. Sheet 22 comprises central longitudinal axis 24 dividing sheet 22 into a left half 26 and a right half 28. Left half 26 is a mirror image of right half 28. Sheet 22 comprises a perimeter edge 30 that extends all around sheet 22. As best shown by FIG. 6, perimeter edge 30 has a plurality of closely spaced non-continuous catch portions or notches 32 all around sheet 22. Each of the catch portions 32 comprise an opening 80 and opposing first and second edges 82 and 84 that engage with the lining of the cap to prevent insert 20 from slipping or otherwise moving within cap 10 during use. The distance or spacing between the first and second edges 82 and 84 (and the size of opening 80) is very small when compared with the size of the first, second, third or four fingers 48, 52, 58, and 72. The small spacing of catch portions 32 increases engagement area between insert 20 and cap 10. Catch portions 32 may take a variety of shapes such as a half-rectangle. Sheet 22 further comprises a substantial number of vent holes 34 throughout sheet 22 to provide ventilation thru sheet 22. In the embodiment shown, the holes are square shaped to maximize the number of holes per square inch of sheet 22 and thus ventilation.

Sheet 22 further comprises a lower portion 38 having a central edge portion 40, and left and right edge portions 42 and 44. Sheet 22 comprises a v-shaped cut-out 46 extending inward from central edge portion 40. As shown best by FIG. 7, v-shaped cut-out 46 allows first half 26 and right half 28 to be flexed inward so that left and right edge portions 42 and 44 may be seated in a lower pocket 18 of cap 10.

Figures 2, 3, 4, 5:
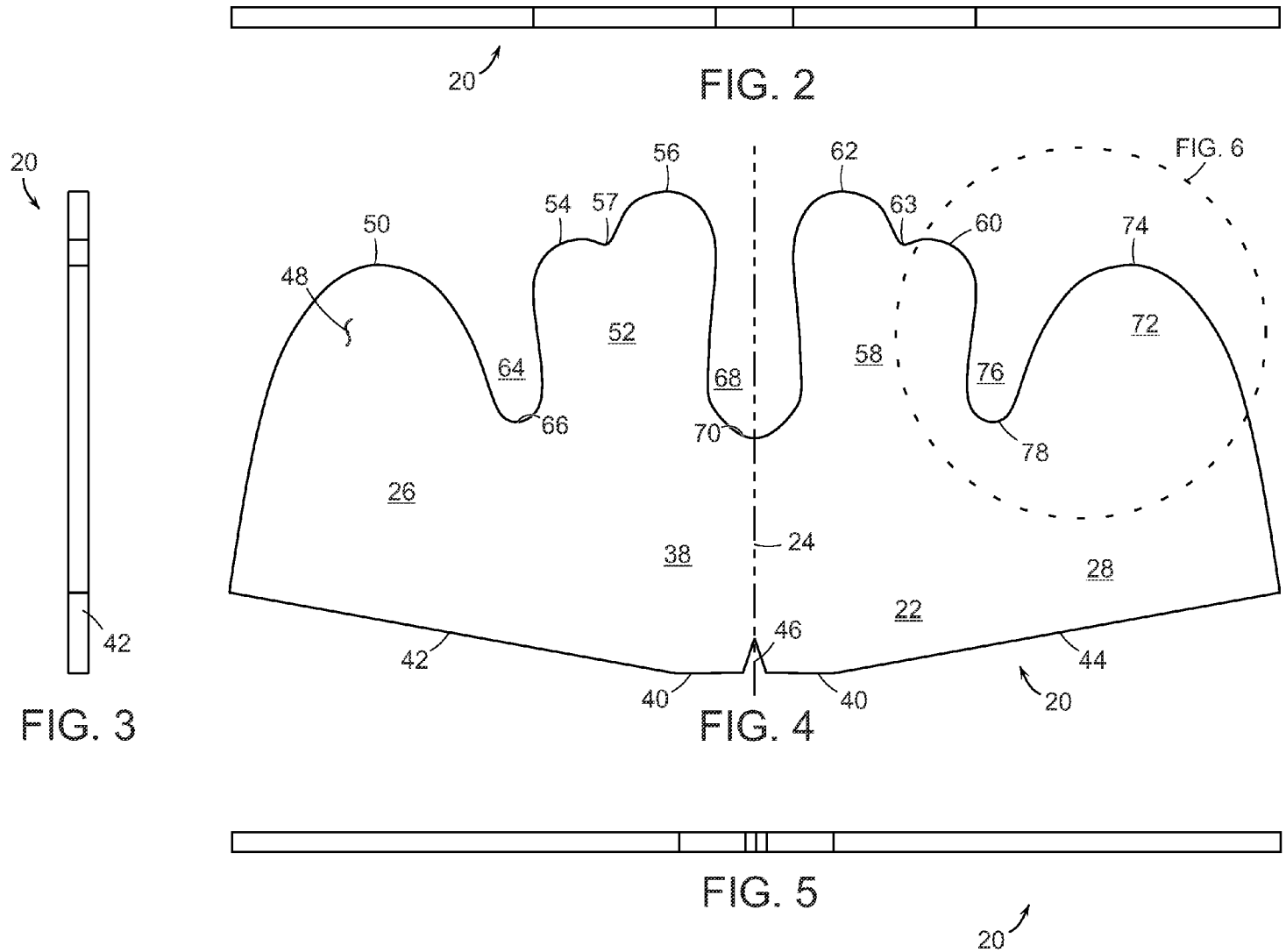
FIG. 2 is a top view of the insert.
FIG. 3 is a left end view of the insert—right end being a mirror image.
FIG. 4 is a front plan view of the insert—back plan view being a miro image.
FIG. 5 is a rear view of the insert.
Figure 7:
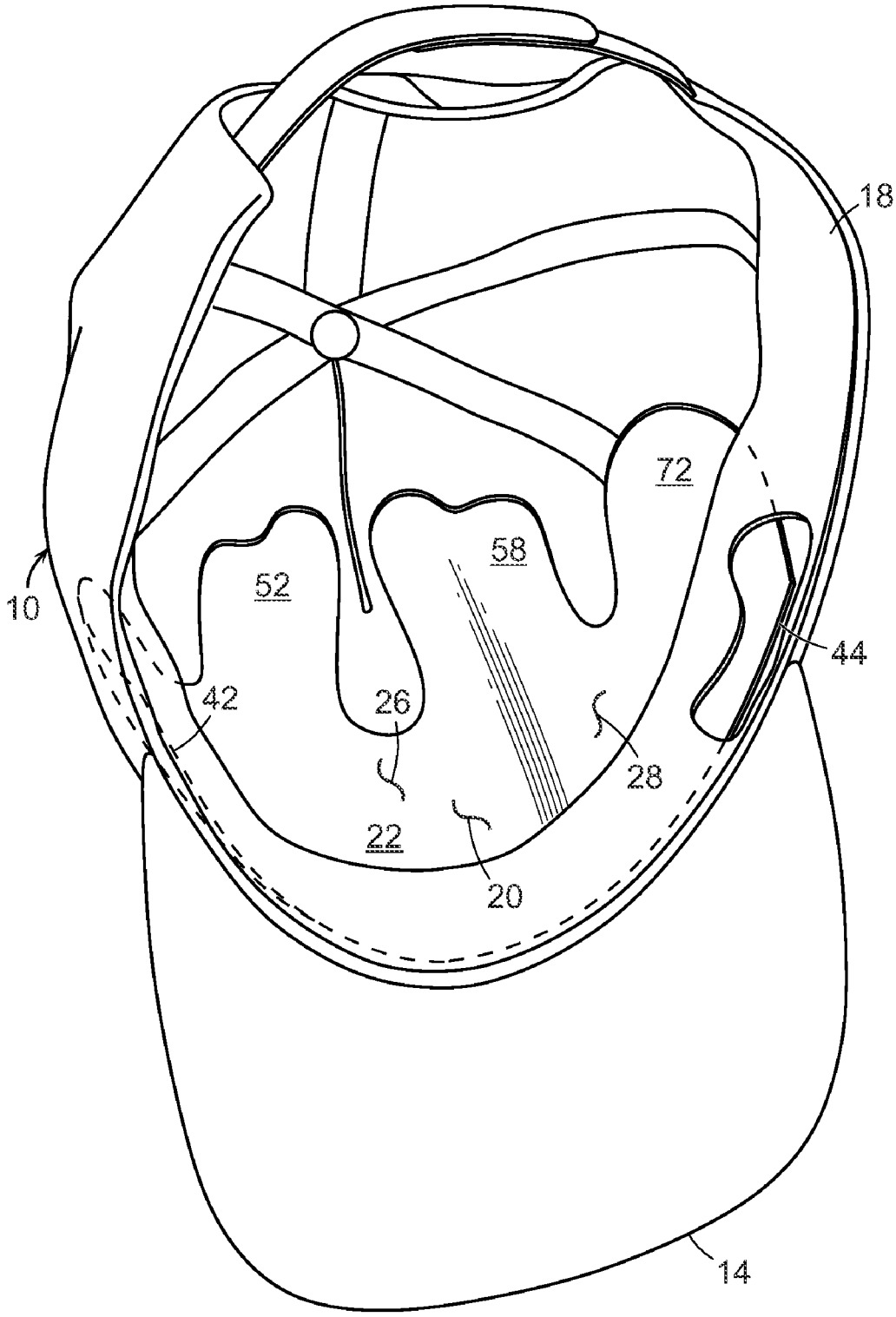
FIG. 7 is a perspective view of the insert positioned within the cap.

Sheet 22 further comprises a first finger 48 extending upward from lower portion 38. First finger 48 has a generally concaved shaped peak 50. Sheet 22 further comprises a second finger 52 extending upward from lower portion 38. Second finger 52 has first and second generally concaved shaped peaks 54 and 56 separated by a valley 57. Sheet 22 further comprises a third finger 58 extending upward from lower portion 38. Third finger 58 has first and second generally concaved shaped peaks 60 and 62 separated by a valley 63. Sheet 22 further comprises a fourth finger 72 extending upward from lower portion 38. Fourth finger 72 has a generally concaved shaped peak 74. Sheet 22 further comprising a first valley 64 separating first and second fingers 48 and 52. First valley 64 has a bottom edge 66. Sheet 22 further comprises a second valley 68 separating second and third fingers 52 and 58. Second valley 68 has a bottom edge 70. Sheet 22 further comprises a third valley 76 between third and fourth fingers 72. Third valley 76 has a lower edge 78. Peaks 56 and 62 are taller than peaks 50 and 74. Fingers 48 and 72 are wider than fingers 52 and 58. As best shown by FIG. 4, the distance from left edge 42 of lower portion 38 to bottom edge 66 of first valley 66 is substantially less than the distance from left edge 42 of lower portion 38 to peak 50 of first finger 48 and first and second peaks 54 and 56 of second finger 52. The distance from right edge 44 of lower portion 38 to bottom edge 78 of third valley 76 is substantially less than the distance from right edge 44 to peak 74 of fourth finger 72 and first and second peaks 60 and 62 of third finger 58. The distance from central edges 40 of lower portion 38 to bottom edge 66 of first valley 64 is substantially less than the distance from central edges 40 to peak 50 of first finger 48, and first and second peaks 54 and 56 of second finger 52, and first and second peaks 60 and 62 of third finger 58, and peak 74 of fourth finger 72. The distance from left edge 42 of lower portion 38 to peak 56 of second finger 52 is greater than the distance from left edge 42 of lower portion 38 to peak 54 of second finger 52. As best shown by FIG. 7, with the above configuration of insert 22, fingers 48, 52, 58, and 72 can be flexed to support the concave shape of top portion 16 of cap 10.

The foregoing description is intended for purposes of illustration. The invention may be embodied in other forms or carried out in other ways without departing from the spirit or scope of the invention.

What is claimed is:

1. An insert for a cap comprising: a one piece flexible sheet having a longitudinal central axis; said flexible sheet having a peripheral edge; a plurality of closely spaced catch portions disposed along said peripheral edge all around said sheet; each of said catch portions comprise opposing first and second edges; said sheet comprising a substantial number of vent holes; said flexible sheet comprising a lower portion having a central edge substantially perpendicular to said central axis; said lower portion further comprises left and right edges inclined to said central axis; said sheet further comprising a first finger extending upward from said lower portion; said first finger comprises a peak; said sheet further comprising a second finger extending upward from said lower portion and positioned between said first finger and said longitudinal central axis; said second finger having first and second peaks; said sheet further comprising a first valley separating said first and second fingers; said first valley comprises a bottom edge; said sheet further comprising a third finger extending upward from said lower portion and positioned adjacent said longitudinal central axis; said third finger comprises first and second peaks; said sheet further comprises a second valley separating said second and third fingers; said second valley comprises a bottom edge; said sheet further comprises a fourth finger having a peak; said sheet further comprising a third valley separating said third and fourth fingers.

2. The insert of claim 1, wherein said peaks of said third and fourth finger are taller than said peaks of said first and fourth fingers; said first and fourth fingers are wider than said second and third fingers; and said distance from said left edge of said lower portion to said bottom edge of said first valley is substantially less than said distance from said left edge of said lower portion to said peak of said first finger.

3. The insert of claim 2, wherein said distance from said right edge of said lower portion to said bottom edge of said third valley is substantially less than said distance from said right edge of said lower portion to said peak of said fourth finger.

4. The insert of claim 3, wherein said distance from said central edges of said lower portion to said bottom edge of said second valley is substantially less than said distance from said left edge of said lower portion to said peak of said first finger and said first and second peaks of said second finger.

5. The insert of claim 4, wherein said distance from said central edges of said lower portion to said bottom edge of said second valley is substantially less than said distance from said right edge of said lower portion to said first and second peaks of said second finger and said peak of said fourth finger.

6. The insert of claim 5, wherein said distance from said left edge of said lower portion to said first peak of said second finger is greater than said distance from said left edge of said lower portion to said second peak of said second finger.

7. The insert of claim 6, wherein said distance from said right edge of said lower portion to said first peak of said third finger is greater than said distance from said right edge of said lower portion to said second peak of said third finger.

8. The insert of claim 7, wherein said peaks of said first and fourth fingers are concave shaped.

9. The insert of claim 8, wherein said first and second peaks of said second finger are concave shaped.

10. The insert of claim 9, wherein said first and second peaks of said third finger are concave shaped.

11. The insert of claim 10, wherein said vent holes are square shaped.

12. The insert of claim 1, wherein each of said catch portions comprises an opening separating said opposing first and second edges.

* * * * *